United States Patent [19]

Cooper

[11] 4,280,556

[45] Jul. 28, 1981

[54] HEAT EXCHANGER-TANK ASSEMBLY FOR HOT WATER HEATING SYSTEM

[75] Inventor: George H. Cooper, Bridgton, Me.

[73] Assignee: Suntime, Inc., Belfast, Me.

[21] Appl. No.: 114,385

[22] Filed: Jan. 22, 1980

[51] Int. Cl.[3] ..... F28F 9/00

[52] U.S. Cl. ..... 165/76; 126/378; 165/157

[58] Field of Search ..... 165/157, 76, 162, 163; 126/376–378, 361, 366, 368

[56] References Cited

U.S. PATENT DOCUMENTS

| | | | |
|---|---|---|---|
| 205,153 | 6/1878 | Tregent | 165/163 |
| 1,094,416 | 4/1914 | Baxter | 165/163 |
| 2,530,519 | 11/1950 | Guggenheim | 165/162 |
| 3,171,477 | 3/1965 | Huet | 165/163 |

FOREIGN PATENT DOCUMENTS

| | | | |
|---|---|---|---|
| 621822 | 5/1927 | France | 165/163 |
| 639236 | 6/1928 | France | 165/157 |

*Primary Examiner*—Sheldon J. Richter

[57] ABSTRACT

A heat exchanger-tank assembly is shown for use in a solar hot water heating system. Heat exchanger tubing extends between inlet and outlet manifolds defining downwardly sloping paths wherein the heat transfer medium may circulate. The heat exchanger is completely assembled outside a tank body and then installed therein. Inlet and outlet tubes protrude through suitable openings in the tank, one of which is defined by mating semi-circular cuts in an end cap and adjacent tank rim. Both horizontal and vertical tank embodiments are shown.

5 Claims, 6 Drawing Figures

HEAT EXCHANGER-TANK ASSEMBLY FOR HOT WATER HEATING SYSTEM

BACKGROUND OF THE INVENTION

This invention relates to heat exchanger assemblies comprising a water heating tank and a heat exchanger mounted therein through which a suitable thermosyphon medium is circulated from a heat collector so as to give up its heat to the water and return to the collector where it collects more heat to be transferred to the water. Preferably the medium is of the liquid-gas phase change type, such as Freon, and the assembly is employed as part of a solar hot water heating system.

In such a system it is highly desirable that the circulation of the medium proceed with the least obstruction. If the medium is passed through a heat exchanger comprising a coiled tube immersed in a tank the freedom of circulation is greatly inhibited by the restricted path and efficiency is greatly reduced. Additionally, in any such system it is important to reduce to a minimum the likelihood of contaminating leakage of the medium within the tank into the water being heated.

It is an object of the invention to provide a heat exchanger-tank assembly for use in a hot water heating system which provides maximum freedom of circulation for the medium employed and greatly improved security against leakage by eliminating the need for making any seals in the medium circulating elements once the heat exchanger has been tested and mounted in the tank, i.e., only seals on the water side being required after assembly.

The invention also includes a novel method of assembly of the several components.

BRIEF STATEMENT OF THE INVENTION

According to the invention there is provided a heat exchanger-tank assembly comprising a tank having an elongated body portion open at both ends, a pair of end caps to close both ends of said body portion and a heat exchanger mounted in said tank. The heat exchanger features an inlet manifold located at one end of the tank, an outlet manifold located at the other end of the tank and a series of heat exchanger tubes sealed in communication with the manifolds and placing them in communication with each other through parallel paths, said tubes extending downwardly from the inlet end to the outlet end to promote drainage. The outlet manifold has an outwardly directed outlet drain tube connected to the lowest point thereof and the inlet manifold has an outwardly extending inlet tube connected thereto, the tank being provided with openings adjacent the manifolds for the inlet and outlet tubes. Thereby the heat exchanger, in fully assembled and sealed condition, may be bodily inserted into the tank through an open end thereof while only one end cap is in place with its inlet and outlet tubes protruding through the respective openings, the remaining end cap being adapted thereafter to be assembled to the body portion to close said tank.

In one preferred embodiment, the tank is adapted, in use, to have its major axis arranged horizontally and the exchanger tubes are generally parallel to each other and slope uniformly downwardly from the inlet end to the outlet end, the inlet manifold being located near the middle elevation of the tank and the outlet manifold in the lower half of the tank. In another preferred embodiment the tank is adapted, in use, to have its major axis arranged vertically with the exchanger tubes extending from top to bottom thereof. In both forms of the invention, preferably, a nipple surrounds both the outlet tube for and the inlet tube for welding to the tank; the opening for the outlet tube is in the end cap at the outlet end of said tank; the opening for the inlet tube is formed by mating semi-circular cuts in the end cap and adjacent rim of the body portion at the inlet end of the tank to define a circular opening through which the inlet tube protrudes; and the aforesaid inlet and outlet tubes are silver soldered to their respective nipples.

In the vertically arranged embodiment, preferably the exchanger tubes are bent into zig-zag formation, it being further preferred that the manifolds have substantially the cross section of a right triangle and that the ends of the exchanger tubes be inserted and sealed in openings in adjacent sides thereof, the bends in said tubes being right angle bends to form two series of zig-zag tubes extending between the manifolds all with right angled bends whereby the same length tubes may have their bends at different locations but nevertheless terminate at the same place.

The invention also includes the novel method of making a heat exchanger-tank assembly having a tank containing a tubular heat exchanger unit which has a pair of manifolds, one at each end, and a series of tubes extending between, one manifold having an outwardly protruding inlet tube and the other manifold having an outwardly protruding outlet tube. According to the novel method there is provided a tubular body closed at one end except for an opening at that end to receive one of the protruding tubes. The exchanger unit is then inserted into the body through its open end so that one of the protruding tubes extends out through the above mentioned opening. The opposite end of the body is then closed by means having an opening for the other protruding tube; and the joints sealed between the protruding tubes and their respective openings.

Other objects, features and advantages of the invention will appear from the following detailed description of preferred embodiments thereof taken in conjunction with the accompanying drawings.

DETAILED DESCRIPTION OF PREFERRED EMBODIMENTS

Figure 1:
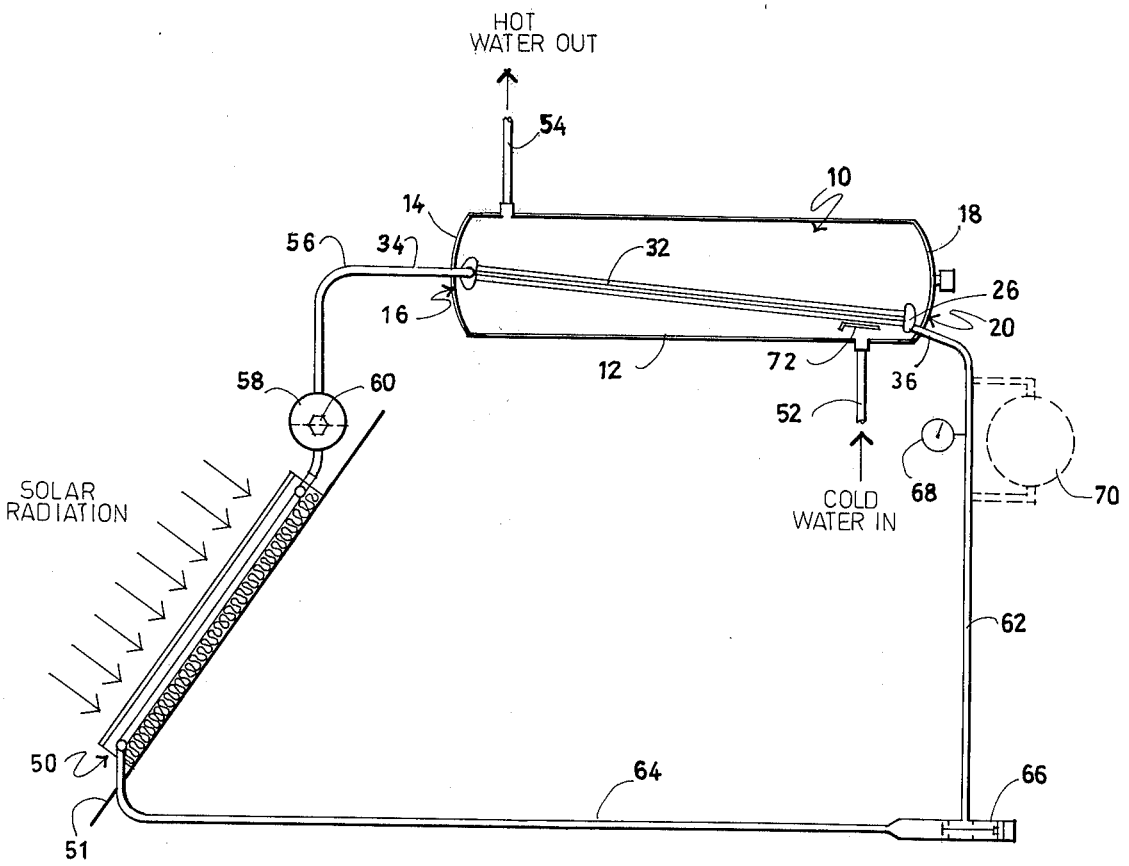
FIG. 1 is a diagrammatic representation of a typical solar hot water heating system employing the heat exchanger-tank of the invention.
Figure 4:
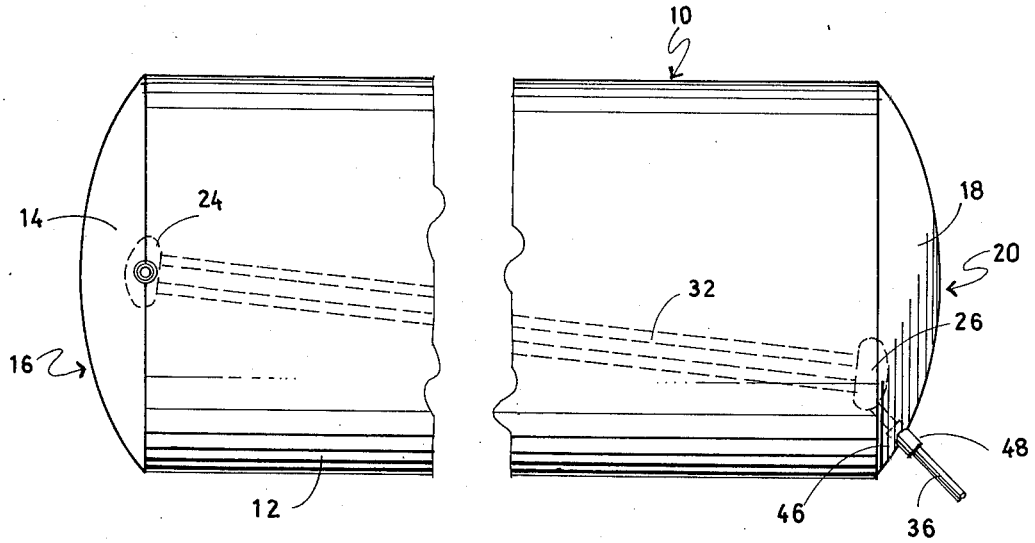
FIG. 4 is a front elevation on a larger scale of the horizontal tank embodiment showing the method of assembly of the heat exchanger therein.

Referring to the drawings, one preferred embodiment of the invention employs a stainless steel tank 10 which is adapted to be installed with its long axis horizontally disposed as shown in FIGS. 1 and 4. This tank serves as both primary heating and hot water storage tank for the system and should be located at an elevation higher than that of the source of heat which, in this instance, is a solar heat collector (FIG. 1) of the type employing a liquid-gas, phase change medium, such as Freon. Such a collector is shown in U.S. Pat. No. 4,120,289 to which reference may be had for details of its construction. The heating and storage tank of the invention is adapted to be substituted for the heat exchanger 18 shown in said patent, although it may be used in other environments with equal success.

Figure 5:
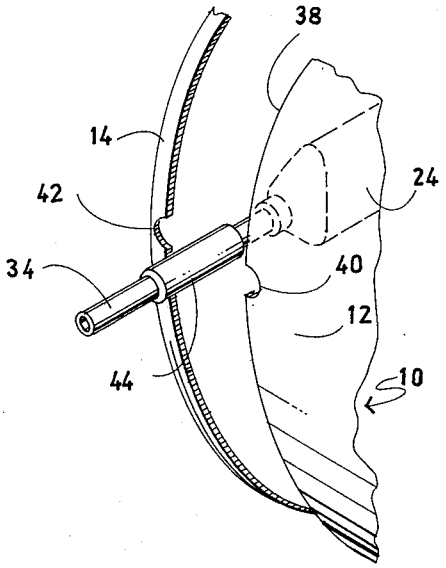
FIG. 5 is a view in elevation of the inlet end portion of the tank of FIG. 4 showing the method of assembling the end cap so that the heat exchanger inlet tube protrudes outwardly from the joint between the cap and the body of the tank.
Figure 6:
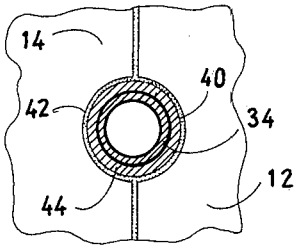
FIG. 6 is a view partially in section of such joint on a still larger scale.

The horizontal tank 10 is comprised of three parts, a cylindrical body 12 and two end caps, cap 14 at the inlet end 16 (FIG. 5) and end cap 18 at the outlet end 20. The heat exchanger assembly 22 of the horizontal embodiment (FIG. 2) is preassembled and is adapted to fit bodily within the tank 10, being inserted through the open inlet end 16 prior to welding on the cap 14.

Figure 2:
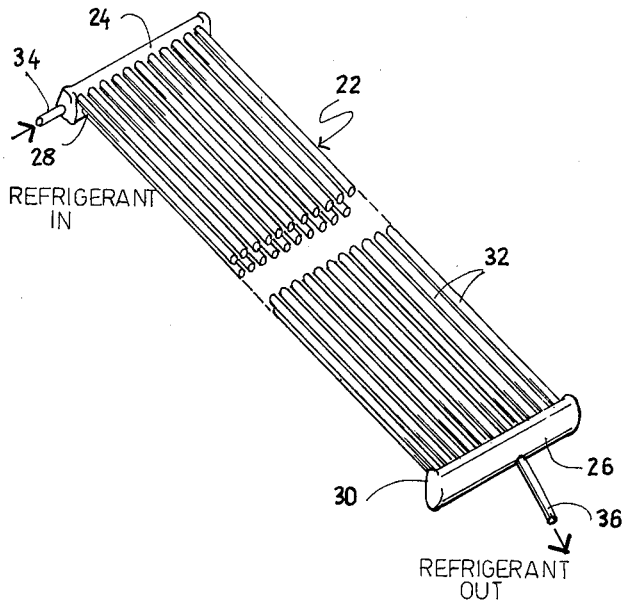
FIG. 2 is a perspective of a horizontal embodiment of the novel heat exchanger itself prior to installation in a horizontal water heating tank.

The construction of the heat exchanger is apparent from FIG. 2. A pair of copper manifolds 24, 26 is provided, one for each end. Each manifold is formed from a relatively large diameter copper tube by pressing into generally oval shape, with one generally flat side, 28, 30 which, when assembled to the copper heat exchanger tubes 32, face each other. The flat faces are provided with a plurality of holes into which the tubes 32 fit and are sealed by silver soldering. The manifold 24, at the inlet end of the assembly, is provided with a laterally extending inlet tube 34 and the manifold 26 at the other end is provided with an axially extending outlet or drain tube 36.

The rim 38 of cylindrical body 12 is provided with a semi-circular cut 40 (FIG. 5) which is adapted to form, with a corresponding cut 42 in end cap 14, a circular opening of size to fit the outer diameter of stainless steel sleeve 44 surrounding inlet tube 34.

The tubular heat exchanger, as mentioned, is slid into the body 12 through an open end so that drain tube 36 protrudes through opening 46 in end cap 18. The other end cap 14 is then placed over the open end of the body 12 with its cut 42 matching cut 40 to form an opening through which protrudes the tube 34 and sleeve 44. The cap 14 is then welded in place; the sleeve 48 welded to the end cap and the tube 36 silver soldered to the sleeve 44. At the inlet end 16 the sleeve 44 is welded to the cap 14 and adjacent rim of the body 12 and the tube 34 silver soldered to the sleeve 44.

It will be seen by the arrangement described that the heat exchanger unit may be completely assembled outside the tank in which it is to be installed, tested for leaks and then installed. After it is installed, no seals need be made in any part of it, the only seals required being those for the water system, i.e., on the tank itself to make it watertight. This is important because the heat exchanger will normally carry a liquid-gas, phase change refrigerant, such as Freon, and any leak inside the tank would contaminate the water being heated in the tank.

The use of the heat exchanger-heating tank 10 is illustrated in FIG. 1. The tank 10 is mounted horizontally at an elevation above a solar collector 50, for example, in the rafters of a house on the roof 51 of which, at a lower level, is located the collector 50. Cold water from a suitable source, such as a water main, may enter the tank through water inlet 52 and, after being heated, exit to the house hot water system through water outlet 54. The refrigerant cycle proceeds through a tube 56 from the collector 50 to the inlet 34. Preferably a liquid-gas separator 58, with sight glass 60, is inserted in this tube between the collector and the tank. The gaseous medium rising from the separator enters the heat exchanger and condenses in the tubes 32. The liquid medium drains by gravity from the manifold 26 through outlet tube 36 to return to the bottom of the collector through return tubing 62 and 64.

At a low point in the return tubing a pressure actuated valve 66 of a known type is inserted in the line to halt the circulation of the refrigerant when it reaches a predetermined maximum temperature (which is a function of its pressure). This would occur in conditions of abundant sunlight and little use of hot water whereby the tank 10 would become full of hot water so that the collector must be shut down. Upon closing of valve 66 no further liquid refrigerant can pass to the inlet of the collector. Any which is there will boil away, condense in the heat exchanger and be held stored in liquid form in the tubing until the valve 66 again opens. One pressure actuated valve is that sold by Sporlan Valve Company, St. Louis, Mo., under the designation "CRO." Desirably, a pressure gauge 68 is provided for visual monitoring of the operation. If the aggregate volume of the tubing 32 and 62 is not sufficient to accommodate all the refrigerant in the system in liquid form, an optional auxiliary holding tank 70, shown in broken lines, may be provided to increase the liquid holding capacity. Within the tank 10 a baffle or deflector 72 is desirably provided to prevent incoming cold water from upsetting stratification in the tank.

It should be noted that the provision of multiple parallel paths (tubes 32) within the heat exchanger, all sloping downwardly facilitates drainage of condensate into the manifold 26. The latter drains from its lowest point through tube 36. Thus optimum operation of the system is promoted. There are no low spots in which the liquid medium could collect so as to impede free circulation.

Figure 3:
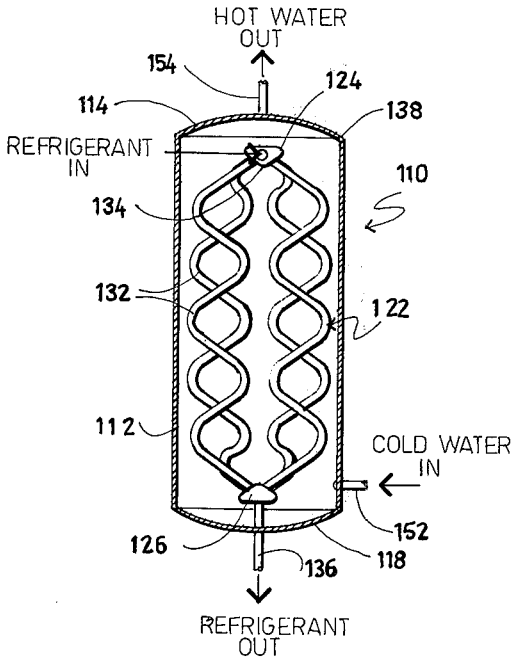
FIG. 3 is a vertical sectional view of vertical embodiment of the heat exchanger of the invention mounted in a vertical tank.

Turning now to FIG. 3, an alternative embodiment is shown employing an upright, rather than a horizontal, tank. The same principles of multiple parallel paths for the condensing refrigerant, large area of heat exchange tubing and unobstructed drainage apply. However, by the use of multiple bends in the heat exchanger tubing it is possible to provide the same length of condenser tubing as in the horizontal tank embodiment but in less lengthwise space, while providing greater heat exchange surface throughout the volume of the tank.

A vertical tank 110 is adapted to contain heat exchanger 122 having multiple bent tubes 132 the ends of which are silver soldered into appropriate openings in upper inlet manifold 124 and lower outlet manifold 126. Water to be heated enters the tank through water inlet 152 and exits through water outlet 154 after taking up heat from the heat exchanger 122.

The two manifolds are formed from round copper tubing of larger diameter than the tubes 132 pressed into generally triangular cross-section with adjacent surfaces at right angles to each other. These surfaces are provided with multiple holes to receive the ends of the tubes 132. The tubes therefore extend away from the manifold surfaces at right angles to each other. They are bent back and forth in a series of right angle bends between the two manifolds. Because of the right angle bends all the tubes may be of the same length even though individual tubes may be bent differently, i.e., with varying lengths between bends, and all terminate at the same place. It will be seen that tubes of the same length as straight tubes 32 of the other embodiment may be employed in this fashion to make an assembled device which will fit in a much shorter lengthwise space. Such an arrangement is highly useful where, in the particular installation, there is insufficient room for a lengthy horizontally disposed tank, such as tank 10.

The method of assembly of the parts is the same, however, as in the horizontal tank embodiment. The heat exchanger is completely assembled, all its tubes silver soldered in place and inlet and outlet tubes 134, 136 connected before installation in the tank 110. After testing for leaks, the heat exchanger is placed in the tank 110 through an end to which the cap 114 has yet to be affixed. The drain tube 136 projects through an opening in lower cap 118 in fashion similar to that of the horizontal tank embodiment. The cap 114 and the adjacent rim 138 of tank 110 are provided with mating semi-circular cuts (not shown) identical with cuts 40 and 42 in the horizontal version to define an opening for the inlet tube for the circulating medium.

The operation of the embodiment of FIG. 3 is the same as that of the horizontal tank version. The vertical tank may be mounted in place of the horizontal tank in the system shown in FIG. 1. The condensed refrigerant will drain rapidly and completely through the vertically extending bent tubes 132 into the lower manifold 126 and out the exit port 136 for recirculation to the solar collector.

There are herein disclosed and described presently preferred embodiments of the invention. It is, nevertheless, intended that the scope of the invention be measured only by the proper interpretation to be afforded the appended claims.

I claim:

1. In a heat exchanger-tank assembly comprising a tank having an elongated body portion, a pair of end caps assembled thereto to close both ends of said body and a preassembled heat exchanger mounted therein, said heat exchanger comprising an inlet manifold at one end thereof, an outlet manifold at the other end thereof and a series of heat exchanger tubes in sealed relation to said manifolds so as to place them in communication with each other, said tubes sloping downwardly to permit drainage by gravity of fluid therethrough, the improvement comprising a drain tube connected to the lowest point of said outlet manifold means providing an opening in the outlet end of said tank for said drain tube so located as to receive said tube when said preassembled heat exchanger is bodily inserted through the opposite end of said body portion prior to being closed by the inlet-end end cap an inlet tube connected to and extending laterally from said inlet manifold and cooperating means on the inlet-end end cap and adjacent portion of said body portion defining an opening for said inlet tube after heat exchanger assembly has been inserted in said body portion and said end cap has been assembled to said body portion.

2. The combination as claimed in claim 1 wherein the openings for said inlet and outlet tubes are provided with nipples welded to said tank to receiving said tubes.

3. The combination as claimed in claim 2 wherein the opening for said outlet tube is provided in the end cap at the outlet end of said tank.

4. The combination as claimed in claim 2 wherein the opening for said inlet tube is formed by mating semi-circular cuts in the end cap and body portion at the inlet end of said tank to define a circular opening through which said inlet tube protrudes.

5. A method of making a heat exchanger-tank assembly comprising a tank containing a tubular heat exchanger unit having a pair of manifolds, one at each end, with a series of tubes extending therebetween, one manifold having a laterally outwardly protruding inlet tube and the other manifold having an outwardly protruding outlet tube, comprising providing a tubular body closed at one end and having an opening at said end to receive said protruding outlet tube;

inserting the exchanger unit into said body through its open end so that said protruding outlet tube extends out through said opening;

closing the opposite end of said body by welding a closure cap thereto, the opening for said inlet tube being provided by an opening defined by mating cut away portions of said cap and the adjacent rim of said body; and sealing the joints between the protruding tubes and their respective openings.

* * * * *